US008661951B2

(12) United States Patent
Gorenflo

(10) Patent No.: US 8,661,951 B2
(45) Date of Patent: Mar. 4, 2014

(54) HAND-GUIDED POWER TOOL

(75) Inventor: Ernst Gorenflo, Bad Rappenau (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 1182 days.

(21) Appl. No.: 12/366,658

(22) Filed: Feb. 6, 2009

(65) Prior Publication Data

US 2009/0193669 A1 Aug. 6, 2009

(30) Foreign Application Priority Data

Feb. 6, 2008 (DE) ..... 10 2008 007 786

(51) Int. Cl.
*B26D 5/00* (2006.01)

(52) U.S. Cl.
USPC ..... 83/61; 30/381; 30/382

(58) Field of Classification Search
USPC ..... 83/61; 30/381–382, 123.4; 477/185, 477/189, 200, 203; 192/129 R, 129 A, 130, 192/131 R
See application file for complete search history.

(56) References Cited

U.S. PATENT DOCUMENTS 4,091,896 A 5/1978 Wieland et al.
4,543,723 A * 10/1985 Bortfeld et al. ..... 30/381
4,662,072 A 5/1987 Wieland et al.
4,680,862 A * 7/1987 Wieland et al. ..... 30/381
5,813,123 A 9/1998 Wieland et al.
5,984,020 A * 11/1999 Meyer et al. ..... 173/2
6,249,733 B1 * 6/2001 Smith ..... 701/50
6,640,444 B1 * 11/2003 Harada et al. ..... 30/277.4
6,896,340 B2 * 5/2005 Kinser et al. ..... 303/192
6,944,958 B1 * 9/2005 King ..... 30/387
7,044,039 B2 * 5/2006 Powell ..... 83/100
7,166,061 B2 * 1/2007 Shimomura et al. ..... 477/199
7,200,941 B2 * 4/2007 Myers ..... 30/382
7,331,111 B2 * 2/2008 Myers ..... 30/382
7,837,594 B2 * 11/2010 Uddin ..... 477/185
2002/0132702 A1 * 9/2002 Muramoto ..... 477/183
2006/0293150 A1 * 12/2006 Baur et al. ..... 477/203
2008/0242502 A1 * 10/2008 Lin ..... 477/80
2010/0064532 A1 * 3/2010 Wittke et al. ..... 30/382
2010/0257743 A1 * 10/2010 George ..... 30/383

* cited by examiner

*Primary Examiner* — Omar Flores Sanchez
(74) *Attorney, Agent, or Firm* — Gudrun E. Huckett

(57) ABSTRACT

A hand-guided power tool has a drive motor and a drive element connected to and driven by the drive motor. A working tool is connected to the drive element and driven by the drive element. A braking device is correlated with the drive element, wherein the braking device in a first state, in which the braking device is applied, blocks the drive element and in a second state, in which the braking device is released, releases the drive element so that the drive elements can rotate freely. The braking device has a brake lever and a sensor that detects the first and second states of the braking device. A control unit is provided, wherein an output signal of the sensor as a state signal of the first state or the second state is supplied to the control unit. The control unit, based on the state signal, controls devices of the power tool.

30 Claims, 2 Drawing Sheets

HAND-GUIDED POWER TOOL

BACKGROUND OF THE INVENTION

The invention relates to a hand-guided power tool, in particular, a motor chain saw, a cut-off machine, a hedge trimmer, a trimmer/brushcutter or the like, comprising a drive motor that drives a working tool by means of a rotating drive element. A braking device is correlated with the rotating drive element; in a first applied state the braking device brakes the drive element and in a second released state the braking element allows the drive element to rotate, wherein the braking device comprises a brake lever.

U.S. Pat. No. 4,662,072 discloses a motor chain saw whose drive motor is an electric motor and drives by means of a sprocket wheel used as a drive element a working tool, i.e., a saw chain circulating on the guide bar. As a braking device a band brake is provided that acts on a brake drum connected fixedly to the drive shaft. When the braking device is applied, i.e., the brake drum is blocked and cannot rotate, switching on the electric motor can cause overload of the motor or of the braking device.

In a chainsaw according to U.S. Pat. No. 4,091,896 an internal combustion engine is provided as a drive motor whose crankshaft drives by means of a centrifugal clutch a sprocket wheel for the saw chain which drives the saw chain so as to circulate on a guide bar. The clutch drum has a braking device correlated therewith that is configured as a band brake. When the band brake is applied the clutch drum is blocked so that a significant wear on the clutch pads can result when the centrifugal clutch engages. Moreover, this can lead to impermissibly high temperatures on the centrifugal clutch.

SUMMARY OF THE INVENTION

It is an object of the present invention to improve a hand-guided power tool of the aforementioned kind in such a way that damage to the power tool by improper utilization of the braking device is prevented.

In accordance with the present invention, this is achieved in that on the braking device a sensor is arranged that detects the state of the braking device, in that the output signal of the sensor as a state signal is sent to a control unit, and in that the control unit controls devices of the power tool as a function of the state signal.

By means of the sensor correlated with the braking device the state of the braking device is detected. The output signal of the sensor is thus at the same time a state signal of the braking device. This state signal is evaluated in the electronic control unit and, as a function of the state signal, the devices of the power tool are controlled such that impermissible operating states that could damage the power tool are prevented.

In a simple way, the operating readiness of the drive motor as a function of the state signal can be switched or controlled by the control unit. In case of an electric chain saw starting of the drive motor would be prevented when the braking device is applied; only once the braking device is released and the sensor indicates this released state to the control unit, starting up the electric chain saw is possible.

When the drive motor is an internal combustion engine, the state signal can be utilized to prevent starting of the internal combustion engine when the drive motor is not running and the braking device is released. Only when the braking device is applied, i.e., movement of the working tool is prevented, the drive motor is switched to operative state, i.e., can be started.

As a function of the state signal, an engine speed limitation of the drive motor can be switched on or off. When between the drive motor and the working tool a centrifugal clutch is arranged, an engine speed limit is selected that is below the engaging speed of the centrifugal clutch. Independent of the type of drive action (internal combustion engine; electric motor), when the braking device is applied, i.e., the drive element is blocked, the engine speed limitation is switched to active state so that coupling of the centrifugal clutch is prevented. The operator detects that with the braking device being applied an engine speed increase is impossible and will therefore release the braking device in order to be able to work with the power tool.

When starting of an internal combustion engine used as the drive motor is enabled even when the braking device is released, by using the output signal as well as, for example, an operating state signal (motor standing still/motor running), an engine speed limitation can be switched to active state that ensures when the starting procedure is performed that the engine speed will not surpass the engaging speed of a centrifugal clutch that drives the working tool. Thus, for released braking device it can be ensured that a working tool will not begin to run when starting the motor of the power tool.

In a further embodiment of the invention the state signal is utilized in order to switch or control a visual and/or acoustic indicator. This indicator can be part of an indicating device that is already existing in the power tool itself or its drive motor. The indicator or indicating device of the power tool will indicate to the operator that the braking device is applied or released. In accordance with the indicated operating state of the braking device, the operator can then switch the braking device to the required state.

In a further embodiment of the invention it is not the drive motor that is being controlled as the main device but auxiliary devices are controlled that are required for operating the power tool and/or the drive motor.

For example, a lubricating oil pump for the chain oil can be controlled or switched in order to prevent overflow of the lubricating oil groove in the guide bar. Chain oil is conveyed when, and only when, the braking device is released. Only when the braking device is released the saw chain can circulate in the guide groove of the guide bar.

It can also be expedient to switch on or off the fuel supply as a function of the state signal. For example, when the braking device is released and the drive motor is not running, the fuel supply can be blocked in order to prevent starting of the internal combustion engine.

In a similar way, starting of the internal combustion engine can be prevented when the starter of the internal combustion engine is switch on or off as a function of the state signal. In this connection, a cable pull starter can be manually blocked, for example, or an electric starter can be switched off.

Depending on the output signal of the sensor, actuators of the power tool, such as solenoid valves, pumps, actuating elements, or the like, can be switched or controlled. In this connection, actuators can be utilized that are to be operated electrically or mechanically. In this way, for example, a valve for the water supply to the cut-off wheel arranged on a cut-off machine can be controlled in order to preferably close the valve and block the water supply when the braking device is applied. It can also be advantageous to control a pump for liquid supply as a function of the output signal; the pump can be switched on or off, for example, for water supply to the cut-off wheel of a cut-off machine.

The engine speed limitation can be realized by intervention in the control unit of an electronic throttle control (e-gas) or electronic throttle valve. Expediently, the engine speed limitation is effected directly by the electronic throttle control. In case of a magnetic throttle control the control action can be appropriately changed in order to carry out an engine speed limitation. In a further embodiment of the invention the engine speed limitation is realized by means of an electronic or mechanical blocking of a throttle trigger lock correlated with the throttle trigger.

Advantageously, the engine speed limitation may be deactivated automatically after a predetermined time interval has lapsed after the starting procedure.

DESCRIPTION OF THE PREFERRED EMBODIMENTS

Figure 1:
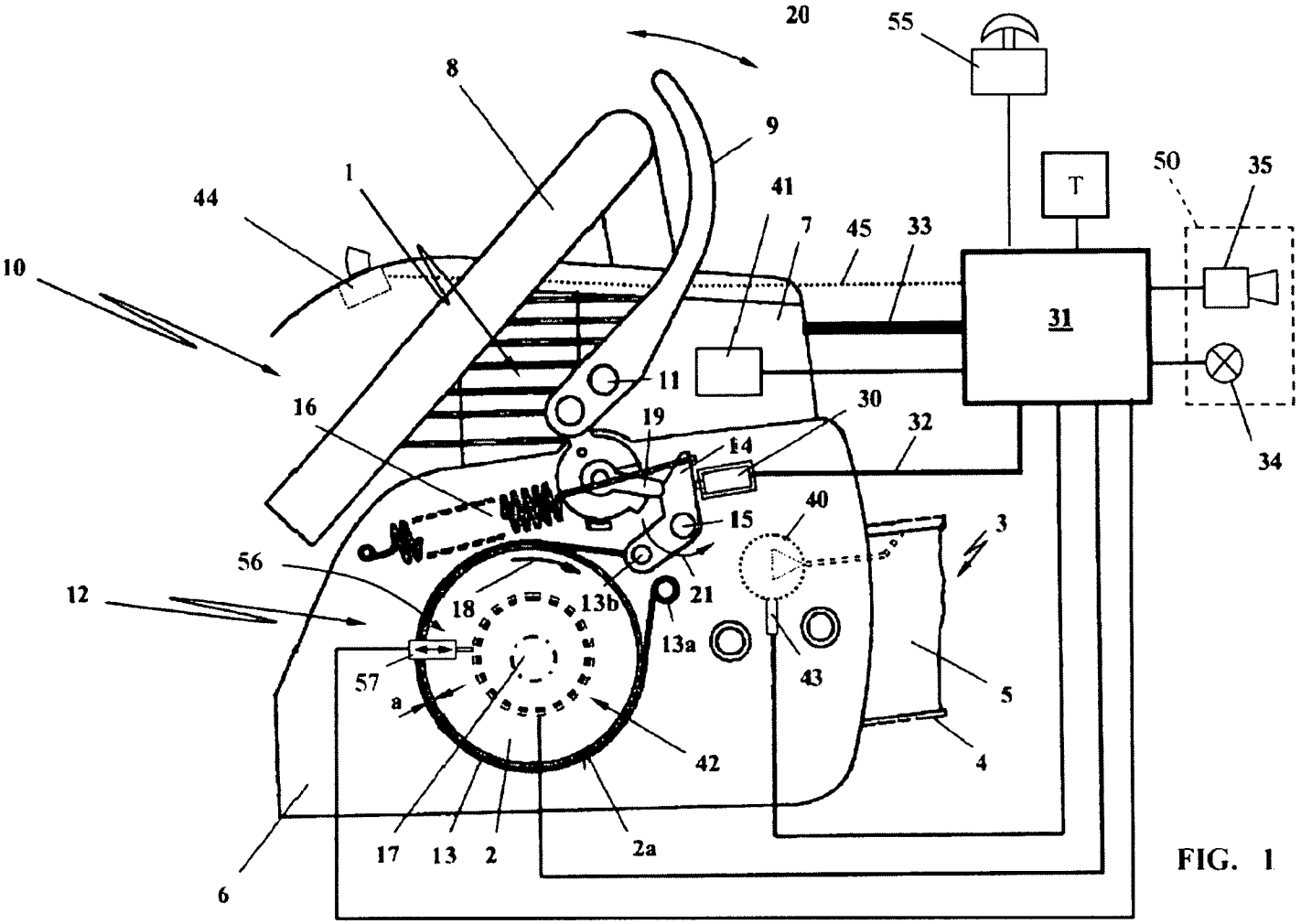
FIG. 1 is a schematic illustration of a part of a motor chainsaw with braking device and control mechanism in accordance with the present invention.

FIG. 1 shows schematically a motor chain saw as an example of a hand-guided power tool which, of course, could also be a cut-off machine, a hedge trimmer, a trimmer/brush-cutter or the like.

The illustrated hand-guided power tool 10 has a drive motor 1 that drives by means of a rotating drive element 2 a working tool 3. In the illustrated embodiment the rotating drive element 2 is a clutch drum, for example, of a centrifugal clutch on which a sprocket wheel (not illustrated in detail) is fixedly arranged. The non-illustrated sprocket wheel drives a saw chain 4 that circulates about guide bar 5. Guide bar 5 is clamped between a sprocket wheel cover 6 and a housing 7 of the motor chainsaw.

Figure 2:
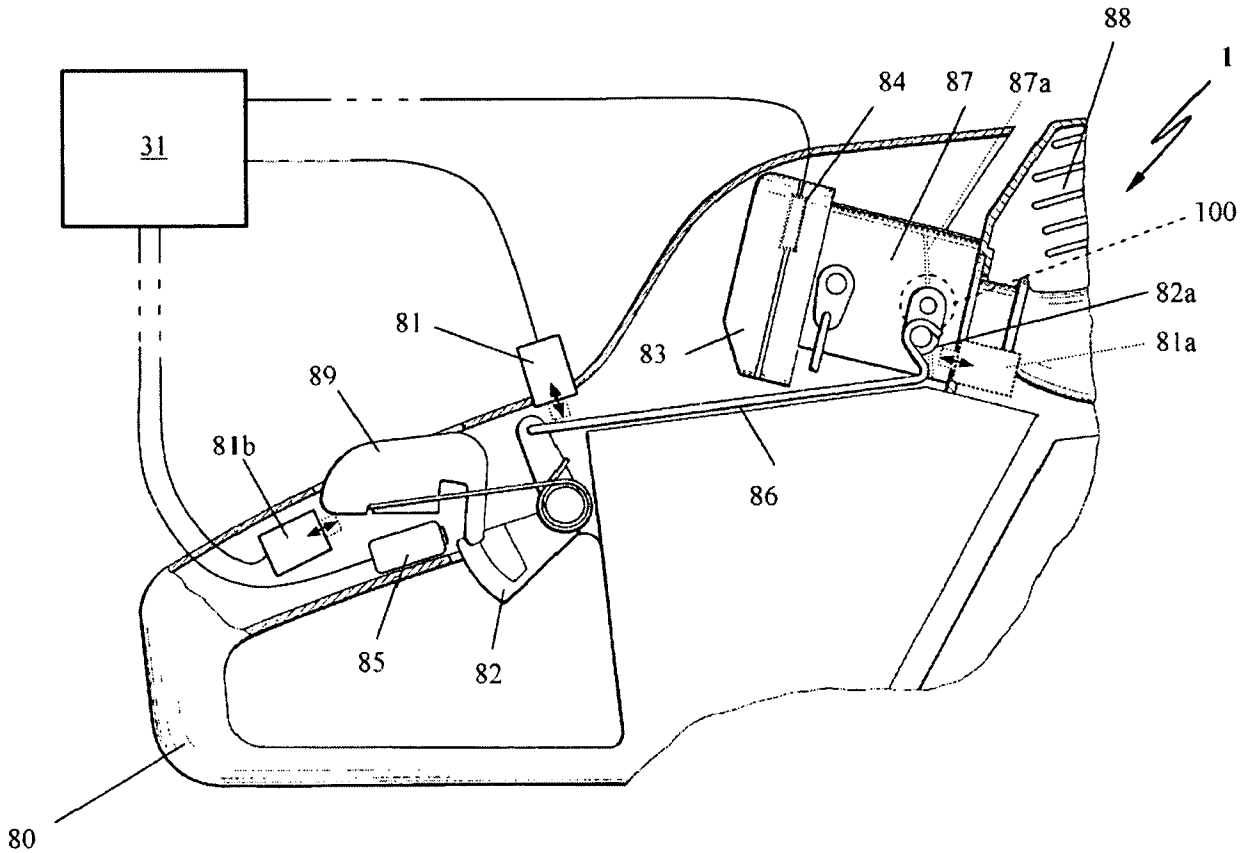
FIG. 2 is a schematic illustration of a carburetor for the an internal combustion engine for a motor chain saw.

The power tool 10 is held by the operator by means of two handles: rear handle 80, illustrated in FIG. 2, as well as front handle 8 that spans the housing 7. In front of the handle 8 there is a hand guard 9 that is arranged to be pivotable about axis 11 on the housing 7 and serves as a trigger for the braking device 12.

The braking device 12 is comprised of a brake band 13 that is secured with the first end 13*a* fixedly to the housing and with the second end 13*b* on the brake lever 14. The brake lever 14 is pivotable about axis 15 secured on the housing and is coupled to the brake spring 16. The brake lever 14 is force-loaded in the sense of applying the brake band 13 against the outer circumference 2*a* of the drive element 2 (in the shown embodiment a clutch drum) in the direction of arrow 21. The arrangement is such when the brake band 13 is applied the band 13 acts to increase the braking action on the drive element 2 rotating in the direction of arrow 18, i.e., the brake band 13 is tightened in the sense of a diameter reduction against the brake surface 2*a* of the drive element 2.

The brake lever 14 is supported by a support lever 19 in the inoperative position (release position) of the braking device 12 wherein the brake band 13 surrounds with minimal play a the brake surface 2*a* of the drive element 2. In this released state of the braking device the drive element 2, driven by the drive shaft 17 of drive motor 1, is able to rotate freely. By means of the rotating drive element 2 the working tool 3 (in the illustrated embodiment of saw chain 4) is driven.

When the hand guard 9 is pivoted by the hand of the operator, by centrifugal forces, or by other forces acting in the direction of arrow 20, by means of a lever mechanism the support lever 19 is moved out of its support position on the brake lever 14 so that the brake lever 14 under the effect of the brake spring 16 is pivoted in the direction of arrow 21, the brake band 13 is applied, and the drive element 2 is braked to a standstill. The power of the braking device 12 is such that the working tool is stopped in a range of approximately 100 milliseconds to standstill.

The braking device 12 in accordance with the invention is provided with a sensor 30 that detects the state of the braking device 12. The sensor 30 can be embodied in a simple way as a micro switch, i.e., can e.g. detect the position of the brake lever 14. The micro switch sends a state signal 0/1 to the control unit 31. Inductive, capacitive, or visual sensors are also advantageously suitable for the detection of the state of the braking device. The output signal of the sensor 30 can thus be referred to as a state signal of the braking device 12. This state signal 12 is supplied to an electronic control unit 31 that evaluates the signal and as a function of the signal controls the devices of the power tool 10.

The term devices of the power tool 10 is to be understood to mean the drive motor 1 as the main device, for example, wherein the drive motor is an internal combustion engine or electric motor.

Devices of the power tool 10 that are controlled as a function of the state signal can also be auxiliary devices, for example, a lubricating oil pump 40 for chain oil, a fuel valve 41 in the fuel supply to the internal combustion engine, or a starter 42. The starter 42 can be a mechanical cable pull starter or an electric starter and acts directly on the crankshaft 17 of the drive motor 1.

When the power tool 10 is a cut-off machine, the auxiliary device is an actuator provided for controlling the water supply to the cut-off wheel that is embodied as a valve and/or as a pump. Based on the output signal of the sensor, the valve arranged on the cut-off machine for supplying water to the cut-off wheel can be switched or controlled. The valve is closed and the water supply blocked when the braking device is applied. It can also be advantageous to switch or control the pump depending on the output signal in order to switch on or off the water supply to the cut-off wheel of a cut-off machine.

The control unit 31 is connected by line 32 to the sensor 30 and communicates by means of control line 33, for example, with an ignition circuit of an internal combustion engine or an engine speed circuit of an electric motor. In this way, by means of the control unit 31 the operating readiness of the drive motor 1 can be controlled based on the state signal of the braking device 12.

In the case of an internal combustion engine as a drive motor 1 it can be provided, for example, that when the drive motor 1 is standing still and the braking device 12 is released, the operating readiness of the drive motor 1 is switched off, i.e., the ignition of the internal combustion engine is switched off. In this way it is achieved that the operator, when the braking device 12 is released, cannot start the internal combustion engine. Only when the braking device 12 is in the applied brake state recommended for the starting procedure in accordance with the operating manual, starting of the internal combustion engine is possible.

When the drive motor 1 is an electric motor, the control unit 31 can prevent dosing of the electric circuit to the drive motor when the braking device 12 is applied. In this way, it is ensured that starting of the electric motor against the applied braking device 12 is not possible.

In a special embodiment of the invention, it is provided that, as a function of the state signal supplied by the sensor 30 in regard to the state of the braking device 12, an engine speed limitation of the drive motor 1 can be switched on or off. This is in particular advantageous when the drive element 2 is comprised of a centrifugal clutch that is arranged between the drive shaft (in the shown embodiment the crankshaft 12) and the working tool 3. The braking device 12 acts on the clutch drum 2 of the centrifugal clutch wherein engaging of the centrifugal clutch can be prevented when the braking device 12 is applied. When the state signal of the sensor 30 indicates to the control unit 31 that the braking device 12 is applied, i.e., the drive element 2 is blocked, an engine speed limitation, e.g. an electronic one, is switched to active state by means of control line 33 and this prevents that the engine speed of the drive motor 1 will surpass the engaging speed of the clutch. As shown in FIG. 2, the engine speed limitation may be realized by means of a mechanical stop 81 or 81*a* that can be moved into the pivot path of the throttle trigger 82 or the throttle lever 82*a*. When the control unit indicates that the braking device 12 is released, the stop 81 is moved out of the pivot path. Accordingly, it is safely prevented mechanically and/or electronically that the centrifugal clutch will engage when the braking device 12 is applied, and this protects the centrifugal clutch from damage.

Engine speed limitation can also be achieved by mechanically blocking the throttle trigger 82 in that e.g. on the throttle trigger lock 89 a stop 81*b* is provided that, in accordance with the double arrow, can be moved into or out of engagement by means of the control unit 31 as a function of the operating and starting parameters. In the engaged position the throttle trigger lock 89 cannot be pushed down and thus cannot be released so that the throttle trigger 82 cannot be actuated.

When the throttle 87*a* (FIG. 2) is actuated e.g. by means of a step motor or directly electromagnetically controllable—as schematically indicated in FIG. 2 by component 100—or the fuel supply is controlled by means of an electrovalve, it is possible, based on the starting condition, to carry out an engine speed limitation electronically by means of the electronic control unit 1.

In a further embodiment of the invention, starting of an internal combustion engine used as drive motor can be enabled when the braking device is released. By using the output signal as well as a further signal, for example, an operating state signal (motor standing still/motor running), an electronic or mechanical engine speed limitation can be switched to active state that ensures for the starting procedure that the engine speed will not surpass the engaging speed of a centrifugal clutch driving the working tool. In this case, for released braking device it is ensured, e.g. mechanically by the stop 81, that the working tool of the power tool will not begin to run when starting the power tool.

The operating state "STARTING" is recognized, for example, by an existing motor management system and/or the ignition device wherein the state "BRAKING DEVICE NOT APPLIED" is detected by the sensor arranged on the braking device. By means of the motor management system the engine speed during the starting procedure is maintained at an engine speed level below the engaging speed of the centrifugal clutch; this is done e.g. by means of ignition interruption and/or ignition timing advance/retardation. The active limitation of the engine speed below the engaging speed is advantageously indicated to the operator, for example, visually or acoustically. After starting of the internal combustion engine the active engine speed limitation is switched off by suitable measures so that the power tool can be operated as intended. Switching off the engine speed limitation after the starting procedure can be realized, for example, by an elapsed timing member T or by actuation of a pushbutton 55 by the operator or an activity performed by the operator, for example, accelerating several times or switching on and off the braking device. The movement of the throttle trigger 82 can be detected by means of a movement sensor 85 (FIG. 2) that preferably operates contactless.

The state signal of the position sensor 30 can be used for switching further devices, i.e., auxiliary devices of the power tool 10 or auxiliary devices of the internal combustion engine 1. For example, switching of a lubricating oil pump 40 for the chain oil is possible so that it is ensured that the lubricating oil pump 40 conveys chain oil into the guide groove of the saw chain 4 when, and only when, the saw chain 4 is circulating about the guide bar. The control of the lubricating oil pump 40 can be realized by a control valve 43 in the lubricating oil conduit or, when using an electrical lubricating oil pump 40, by switching on or off the lubricating oil pump 40.

As a further auxiliary device a control valve 41 in the fuel supply conduit can also be switched so that the fuel supply is controlled as a function of the state signal of the braking device 12.

Starting of the internal combustion engine 1 by the operator can also be realized by starter devices that are embodied as a cable pull starter or electric starter; they can be electrically or mechanically blocked. In case of an embodiment as a cable pull starter a mechanical lock 56 by means of electrically or mechanically actuated actuator 57 can be controlled by the control unit while in the embodiment as an electrical starter the current supply to the starter is blocked. Only when the braking device 12 is in the state required or prescribed for the starting procedure, the control unit 31 actuates the devices (main device and/or auxiliary device) so that the drive motor 1 embodied as internal combustion engine can be started.

In order to indicate to the operator the state of the power tool 10 a visual indicator 34 or also an acoustic indicator 35 can be controlled or switched by the control unit 31. The visual indicator 34 can, for example, indicate the starting readiness of the internal combustion engine while the acoustic indicator 35 is activated when the operator performs a starting procedure even though the internal combustion engine is not yet ready to be started. The indicator can be part of an indicating device 50 of the power tool itself or of the drive motor so that a separate indicating device for the state of the braking device is not needed. On the other hand, the indicators 34 and 35 can also be utilized for indicating other information.

The indicators 34 and 35 can also be used in order to indicate, for example, the starting readiness of an internal combustion engine. Depending on the ignition switch 44 being switched on or off, which ignition switch is connected by signal line 45 to the control unit, and the state signal of the braking device 12, for example, the visual indicator 34 is switched to "green" in order to indicate starting readiness. For this purpose, the ignition switch 44 must be switched to "ON" and the state signal of the sensor 30 must indicate that the braking device 12 is applied.

The visual and/or acoustic indicators 34, 35 can moreover be used as operating state indicators and also can be indicators for engine speed, filling level of the fuel container or of the oil container, or can also be used as a servicing interval indicator.

The state indicator or the indicating device 50 of the power tool can be designed as LED, LCD or any other indicating device 50 and, moreover, can also be utilized for indicating other information, for example, the soiling of an air filter 83 (FIG. 2), for example, of an internal combustion engine used as the drive motor 1. The air filter loading can be indicated by an underpressure sensor 84 that is e.g. arranged in the filtered air chamber of the air filter 83. When the underpressure surpasses a threshold value, this is indicated by means of the indicator and/or the indicating device 50 to the operator. The operator can then clean or exchange the air filter 83. An indicator that is provided for the state indication of the braking device can thus also be used for indicating other information.

In FIG. 2 a carburetor 87 and an air filter 83 for an internal combustion engine 88 are schematically shown. The throttle lever 82*a* is moved through linkage 86 by means of throttle trigger 82. The movement of the throttle trigger 82 can be sensed by means of a contactless sensor 85 and the information sent to the control unit 31.

The control unit 31 is also supplied with the output signal of the underpressure sensor 84 that is arranged in the clean chamber of the air filter 83 placed onto the carburetor 87. Moreover, the control unit 31 is connected to a stop 81 that can be moved in the direction of the double arrows, which stop is e.g. controllable electromechanically or electromagnetically. Depending on the state of the braking device, by means of stop 81 the pivot travel of the throttle trigger 82 can be limited so that the engine speed of the internal combustion engine 86 will not surpass the engaging speed of the clutch.

Instead of positioning the stop 81 within the rear handle 80 on throttle trigger 82, the stop 81 can also be arranged in the area of the throttle lever 82*a*, for which purpose the stop 81*a*, indicated in dashed lines, is provided on the carburetor body. Preferably, the stop 81*a* is mounted immediately on the carburetor body.

The specification incorporates by reference the entire disclosure of German priority document 10 2008 007 786.0 having a filing date of Feb. 6, 2008.

While specific embodiments of the invention have been shown and described in detail to illustrate the inventive principles, it will be understood that the invention may be embodied otherwise without departing from such principles.

What is claimed is:

1. A hand-guided power tool comprising:

a drive motor;

a drive element connected to the drive motor and driven in rotation by the drive motor;

a working tool connected to the drive element and driven by the drive element;

a braking device correlated with the drive element, wherein the braking device in a first state, in which the braking device is applied, blocks the drive element and in a second state, in which the braking device is released, releases the drive element so that the drive element can rotate freely;

wherein the braking device comprises a brake lever;

wherein the braking device comprises a sensor that detects the first and second states of the braking device;

a control unit;

wherein an output signal of the sensor as a state signal of the first state or the second state is supplied to the control unit;

wherein the control unit, based on the state signal, controls devices of the power tool;

at least one auxiliary device, wherein, based on the state signal, the at least one auxiliary device is controlled;

wherein the power tool is a motor chain saw and wherein the at least one auxiliary device is a lubricating oil pump for chain oil.

2. The power tool according to claim 1, wherein the sensor is arranged on the brake lever and wherein a position of the brake lever is determined by the first and second states of the braking device.

3. The power tool according to claim 1, wherein the braking device is a band brake.

4. A hand-guided power tool comprising:

a drive motor;

a drive element connected to the drive motor and driven in rotation by the drive motor, wherein the drive element is a clutch drum of a centrifugal clutch;

a working tool connected to the drive element and driven by the drive element;

a braking device correlated with the drive element, wherein the braking device in a first state, in which the braking device is applied, blocks the drive element and in a second state, in which the braking device is released, releases the drive element so that the drive element can rotate freely;

wherein the braking device comprises a brake lever;

wherein the braking device comprises a sensor that detects the first and second states of the braking device;

a control unit;

wherein an output signal of the sensor as a state signal of the first state or the second state is supplied to the control unit; and wherein the control unit, based on the state signal, controls devices of the power tool;

wherein the drive motor is an internal combustion engine comprising a starter device wherein the starter device is a cable pull starter and has a mechanical blocking means switched on or off based on the state signal.

5. The power tool according to claim 4, wherein the end of the starting procedure of the drive motor is determined by a predetermined action of the operator.

6. A hand-guided power tool comprising:

a drive motor;

a drive element connected to the drive motor and driven in rotation by the drive motor;

a working tool connected to the drive element and driven by the drive element;

a braking device correlated with the drive element, wherein the braking device in a first state, in which the braking device is applied, blocks the drive element and in a second state, in which the braking device is released, releases the drive element so that the drive element can rotate freely;

wherein the braking device comprises a brake lever;

wherein the braking device comprises a sensor that detects the first and second states of the braking device;

a control unit;

wherein an output signal of the sensor as a state signal of the first state or the second state is supplied to the control unit;

wherein the control unit, based on the state signal, controls devices of the power tool;

at least one auxiliary device, wherein, based on the state signal, the at least one auxiliary device is controlled;

wherein the power tool is a cut-off machine and wherein the at least one auxiliary device is at least one of a valve and/or a pump of a water supply to a cut-off wheel of the cut-off machine.

7. The power tool according to claim 6, wherein the sensor is arranged on the brake lever and wherein a position of the brake lever is determined by the first and second states of the braking device.

8. The power tool according to claim 6, wherein the braking device is a band brake.

9. A hand-guided power tool comprising:

a drive motor;

a drive element connected to the drive motor and driven in rotation by the drive motor, wherein the drive element is clutch drum of a centrifugal clutch;

a working tool connected to the drive element and driven by the drive element;

a braking device correlated with the drive element, wherein the braking device in a first state, in which the braking device is applied, blocks the drive element and in a second state, in which the braking device is released, releases the drive element so that the drive element can rotate freely;

wherein the braking device comprises a brake lever;

wherein the braking device comprises a sensor that detects the first and second states of the braking device;

a control unit;

wherein an output signal of the sensor as a state signal of the first state or the second state is supplied to the control unit;

wherein the control unit, based on the state signal, controls devices of the power tool;

wherein the drive motor is an internal combustion engine comprising a fuel supply wherein the fuel supply is switched on or off based on the state signal.

10. The power tool according to claim 9, wherein the sensor is arranged on the brake lever and wherein a position of the brake lever is determined by the first and second states of the braking device.

11. The power tool according to claim 9, wherein the braking device is a band brake.

12. A hand-guided power tool comprising:

a drive motor;

a drive element connected to the drive motor and driven in rotation by the drive motor, wherein the drive element is clutch drum of a centrifugal clutch;

a working tool connected to the drive element and driven by the drive element;

a braking device correlated with the drive element, wherein the braking device in a first state, in which the braking device is applied, blocks the drive element and in a second state, in which the braking device is released, releases the drive element so that the drive element can rotate freely;

wherein the braking device comprises a brake lever;

wherein the braking device comprises a sensor that detects the first and second states of the braking device;

a control unit;

wherein an output signal of the sensor as a state signal of the first state or the second state is supplied to the control unit;

wherein the control unit, based on the state signal, controls devices of the power tool;

wherein the drive motor is an internal combustion engine comprising an electric starter and wherein an operating readiness of the electric starter is switched on or off based on the state signal.

13. The power tool according to claim 12, wherein the sensor is arranged on the brake lever and wherein a position of the brake lever is determined by the first and second states of the braking device.

14. The power tool according to claim 12, wherein the braking device is a band brake.

15. A hand-guided power tool comprising:

a drive motor;

a drive element connected to the drive motor and driven in rotation by the drive motor, wherein the drive element is clutch drum of a centrifugal clutch;

a working tool connected to the drive element and driven by the drive element;

a braking device correlated with the drive element, wherein the braking device in a first state, in which the braking device is applied, blocks the drive element and in a second state, in which the braking device is released, releases the drive element so that the drive element can rotate freely;

wherein the braking device comprises a brake lever;

wherein the braking device comprises a sensor that detects the first and second states of the braking device;

a control unit;

wherein an output signal of the sensor as a state signal of the first state or the second state is supplied to the control unit;

wherein the control unit, based on the state signal, controls devices of the power tool;

an engine speed limitation configured such that, after a starting procedure of the drive motor, the engine speed limitation is deactivated after lapse of a timing member.

16. The power tool according to claim 15, wherein, based on the state signal, an engine speed limitation of the drive motor is switched on or off.

17. The power tool according to claim 16, wherein the engine speed limitation of the drive motor is switched on during a starting procedure of the drive motor and when the braking device is in the second state.

18. The power tool according to claim 16, wherein the engine speed limitation of the drive motor is switched on when the drive motor is running and the braking device is in the first state.

19. A hand-guided power tool comprising:

a drive motor;

a drive element connected to the drive motor and driven in rotation by the drive motor;

a working tool connected to the drive element and driven by the drive element;

a braking device correlated with the drive element, wherein the braking device in a first state, in which the braking device is applied, blocks the drive element and in a second state, in which the braking device is released, releases the drive element so that the drive element can rotate freely;

wherein the braking device comprises a brake lever;

wherein the braking device comprises a sensor that detects the first and second states of the braking device;

a control unit;

wherein an output signal of the sensor as a state signal of the first state or the second state is supplied to the control unit;

wherein the control unit, based on the state signal, controls devices of the power tool;

wherein, based on the state signal, an engine speed limitation of the drive motor is switched on or off; and wherein the engine speed limitation of the drive motor is switched on during a starting procedure of the drive motor and when the braking device is in the second state.

20. The power tool according to claim 19, wherein at least one of a visual indicator and an acoustic indicator is controlled based on the state signal.

21. The power tool according to claim 20, comprising an indication device wherein the visual indicator is part of the indication device.

22. The power tool according to claim 19, wherein an operating readiness of the drive motor is switched off when the drive motor is standing still and the braking device is in the second state.

23. The power tool according to claim 22, wherein the drive motor is an internal combustion engine having an ignition device that is switched on or off based on the state signal.

24. The power tool according to claim 23, comprising at least one of a visual indicator and an acoustic indicator, wherein, based on a position of an ignition switch of the ignition device, said at least one of a visual indicator and/or acoustic indicator is switched on.

25. The power tool according to claim 19, wherein the drive motor is an internal combustion engine and the control unit effects an engine speed limitation of the drive motor by controlling an electronic throttle control or electronic throttle valve.

26. The power tool according to claim 19, wherein the drive motor is an internal combustion engine comprising an electronic throttle control that is directly electronically controlled to directly effect an engine speed limitation of the drive motor.

27. The power tool according to claim 19, wherein the drive motor is an internal combustion engine comprising a magnetic throttle control that is controlled by the control unit to effect an engine speed limitation of the dive motor.

28. The power tool according to claim 19, wherein an engine speed limitation is realized by a mechanical lock within a pivot path of a throttle of the drive motor or a throttle trigger lock of the drive motor.

29. The power tool according to claim 19, wherein the sensor is arranged on the brake lever and wherein a position of the brake lever is determined by the first and second states of the braking device.

30. The power tool according to claim 19, wherein the braking device is a band brake.

* * * * *